US007343865B2

(12) United States Patent
Shuert

(10) Patent No.: US 7,343,865 B2
(45) Date of Patent: Mar. 18, 2008

(54) RACKABLE TWIN SHEET PALLET

(75) Inventor: Lyle H. Shuert, Bloomfield Hills, MI (US)

(73) Assignee: Schuert Technologies LLC, Sterling Heights, MI (US)

( * ) Notice: Subject to any disclaimer, the term of this patent is extended or adjusted under 35 U.S.C. 154(b) by 123 days.

(21) Appl. No.: 11/333,170

(22) Filed: Jan. 17, 2006

(65) Prior Publication Data

US 2007/0163473 A1 Jul. 19, 2007

(51) Int. Cl.
*B65D 19/38* (2006.01)

(52) U.S. Cl. ..... 108/57.25

(58) Field of Classification Search ..... 108/57.25, 108/51.11, 901, 902, 56.1, 56.3, 57.26, 57.33
See application file for complete search history.

(56) References Cited

U.S. PATENT DOCUMENTS

| | | | | |
|---|---|---|---|---|
| 4,606,278 | A | 8/1986 | Shuert | |
| 4,742,781 | A | 5/1988 | Shuert | |
| 5,042,396 | A | 8/1991 | Shuert | |
| 5,117,762 | A | 6/1992 | Shuert | |
| 5,791,262 | A * | 8/1998 | Knight et al. | 108/57.25 |
| 5,794,544 | A * | 8/1998 | Shuert | 108/57.25 |
| 6,125,770 | A * | 10/2000 | Brandenburg | 108/57.25 |
| 6,199,488 | B1 * | 3/2001 | Favaron et al. | 108/57.25 |
| 6,357,366 | B1 * | 3/2002 | Frankenberg | 108/57.25 |
| 6,446,563 | B1 * | 9/2002 | Ohanesian | 108/57.25 |
| 6,718,888 | B2 * | 4/2004 | Muirhead | 108/57.25 |
| 6,955,129 | B2 * | 10/2005 | Moore et al. | 108/57.25 |
| 7,086,339 | B2 * | 8/2006 | Apps et al. | 108/57.25 |
| 7,165,499 | B2 * | 1/2007 | Apps et al. | 108/57.25 |

* cited by examiner

*Primary Examiner*—José V. Chen
(74) *Attorney, Agent, or Firm*—Young Basile

(57) ABSTRACT

A plastic twin sheet pallet and a method of forming the pallet. The pallet includes an upper plastic sheet and a lower plastic sheet selectively fused together to form a generally rectangular pallet having an upper platform structure. The pallet further includes a metallic support structure positioned beneath the platform structure between the upper and lower sheets and including a plurality of beam members arranged end to end in a rectangular frame configuration with each beam member generally parallel to and spaced inboard from the respective outer edge of the pallet. The pallet further includes a peripheral groove structure opening upwardly in the platform structure between each beam member and the respective outer edge of the pallet. The pallet defines a peripheral groove structure opening upwardly in the platform structure between each beam member and their respective outer edge of the pallet. With the lower sheet in a heated state the beam members are positioned in upwardly opening channels defined in the lower sheet with beveled ends of the beam members positioned end to end but in spaced relation, whereafter a thermoformed upper sheet is fused to the lower sheet to encapsulate the beam members between the sheets. As the resulting pallet cools and shrinks the end to end and side to side shrinkage of the pallet brings the beveled ends of the beam members together to form a continuous rectangular frame configuration firmly imbedded within the pallet. The pallet further includes reinforcing rods embedded in rectangular configuration in the lower footprint face of the pallet to augment the reinforcing action of the beam members.

16 Claims, 10 Drawing Sheets

RACKABLE TWIN SHEET PALLET

BACKGROUND OF THE INVENTION

This invention relates to shipping and storage pallets and more particularly to plastic pallets embodying a twin sheet construction.

Whereas twin sheet plastic pallets have in general proven to be superior to the wooden pallets previously in use, prior art twin sheet pallets have tended to creep or sag after extended periods of use especially when utilized in a racked manner with opposite edges of the pallet supported by spaced bars of a rack structure.

SUMMARY OF THE INVENTION

This invention is directed to the provision of an improved twin sheet pallet.

More specifically, this invention is directed to the provision of a twin sheet plastic pallet which is resistant to creeping or sag even after extended periods of usage in a racked environment.

Yet more specifically, this invention is directed to the provision of a twin sheet plastic pallet that is rackable in both directions, either side to side or end to end.

The invention pallet is of the plastic twin sheet type comprising an upper plastic sheet and a lower plastic sheet selectibly fused together to form a generally rectangular pallet having an upper platform structure.

According to an important feature of the invention, the pallet further includes a metallic support structure positioned beneath the platform structure between the upper and lower sheets and including a plurality of beam members arranged end to end in a rectangular frame configuration with each beam member generally parallel to a respective outer edge of the pallet.

According to a further feature of the invention, each beam member is spaced inboard with respect to the respective outer edge.

According to a further feature of the invention, the pallet defines a groove structure opening upwardly in the platform structure between each beam member and the respective outer edge.

According to a further feature of the invention, each groove structure is formed by portions of the upper sheet fused to portions of the lower sheet and the portions of the lower sheet forming the groove structures comprise a continuous upwardly opening peripheral groove extending around the perimeter of the lower sheet with bottom walls of the continuous groove forming a continuous rectangular perimeter footprint for the pallet.

According to a further feature of the invention, the upper sheet defines a top wall forming the platform structure and a plurality of circumferentially spaced upwardly opening protrusions extending downwardly from the top wall and nesting within the continuous groove in the lower sheet to form the groove structures.

According to a further feature of the invention, the pallet further includes a plurality of spacer knobs protruding from one of the sheets and fused to the other sheet and serving to space portions of the upper sheet from portions of the lower sheet; at least certain of the spacer knobs are arranged in rows; and the beam members are positioned between adjacent rows of the spacer knobs.

According to a further feature of the invention, the spacer knobs are provided in and extend upwardly from the lower sheet and are fused to an underface of the upper sheet.

According to a further feature of the invention, the pallet further includes upstanding locator knobs positioned between adjacent rows of spacer knobs and engaging an underface of a respective beam member.

According to a further feature of the invention, the pallet further defines a central groove structure opening upwardly in the platform structure and extending between the peripheral groove structure proximate one side edge of the pallet and the peripheral groove structure proximate the opposite side edge of the pallet.

According to a further feature of the invention, the pallet further includes aligned slots in side walls of the peripheral groove structures and in side walls of the central groove structure to allow passage of the forks of a forklift truck.

The invention twin sheet pallet, according to a further aspect of the invention, comprises an upper generally rectangular sheet and a lower generally rectangular sheet selectively fused together to form a generally rectangular pallet having an upper platform structure; the lower sheet is formed with a continuous peripheral upwardly opening groove and a central upwardly opening groove extending from the peripheral groove proximate one side edge of the lower sheet to the peripheral groove proximate an opposite side edge of the sheet; and the upper sheet defines a top wall forming the platform structure and a plurality of circumferentially spaced upwardly opening protrusions, extending downwardly from the top wall and fusedly nested in the continuous peripheral groove in the lower sheet to form a continuous double walled thickness peripheral groove structure, and a plurality of central upwardly opening protrusions extending downwardly from the top wall and fusedly nested in the central groove in the lower sheet to form a double walled thickness central groove structure.

According to a further feature of the invention, the underface of the pallet is configured to define a rectangular perimeter footprint surface and a metal rod is positioned proximate the footprint surface along each side edge of the rectangular footprint surface.

According to a further feature of the invention, each rod is positioned in a downwardly opening channel provided in the footprint surface.

According to a further feature of the invention, each rod is encapsulated by the lower sheet of the pallet by fused plastic material plugging the channel opening following positioning of the rod in the channel.

According to a further feature of the invention, each rod includes a substantially straight main body portion and cranked end portions and the rods are arranged in end to end relation with the cranked end portion of one rod positioned proximate but unconnected to the cranked end portion of an adjacent rod.

According to a further feature of the invention, each cranked end portion extends outwardly toward the respective side edge of the footprint surface.

The invention also provides a method of forming a generally rectangular reinforced twin sheet plastic pallet comprising first and second plastic sheets selectively fused together with metallic beam members encapsulated therebetween.

The invention methodology comprises thermoforming the first sheet to include four elongated channel structures arranged in end to end relation; with the first sheet in a heated state, placing a beam member in each channel structure in end to end relation and with the adjacent beam ends spaced apart; thermoforming the second sheet and fusing it to the first sheet to encapsulate the beam members in the channel structures; and allowing the fused together sheets to cool to allow the pallet to shrink both end to end and side to side to bring the spaced adjacent ends of the beam members together to form a continuous rectangular frame configuration.

According to a further feature of the invention methodology, the beam members have beveled ends which are brought together in response to pallet shrinkage to font a bevel joint between each set of adjacent beam members.

According to a further feature of the invention methodology, the lower sheet of the pallet is configured so that an underface of the lower sheet defines a continuous rectangular footprint surface for the pallet and a metallic rod is positioned proximate the footprint surface along each side edge of the footprint surface.

According to a further feature of the invention methodology, each rod is positioned in a downwardly opening channel provided in the footprint surface.

According to a further feature of the invention methodology, following positioning of each rod in the respective channel, plastic material is fused into the opening of the channel to encapsulate the rod within the lower plastic sheet.

According to a further feature of the invention methodology, each rod includes a substantially straight main body portion and cranked end portions and the rods are arranged in end to end relation proximate the footprint surface with the cranked end portion of one rod positioned proximate but unconnected to the cranked end portion of an adjacent rod.

According to a further feature of the invention methodology, each cranked end portion extends outwardly toward the respective side edge of the footprint surface.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION OF THE PREFERRED EMBODIMENT

Figure 1:
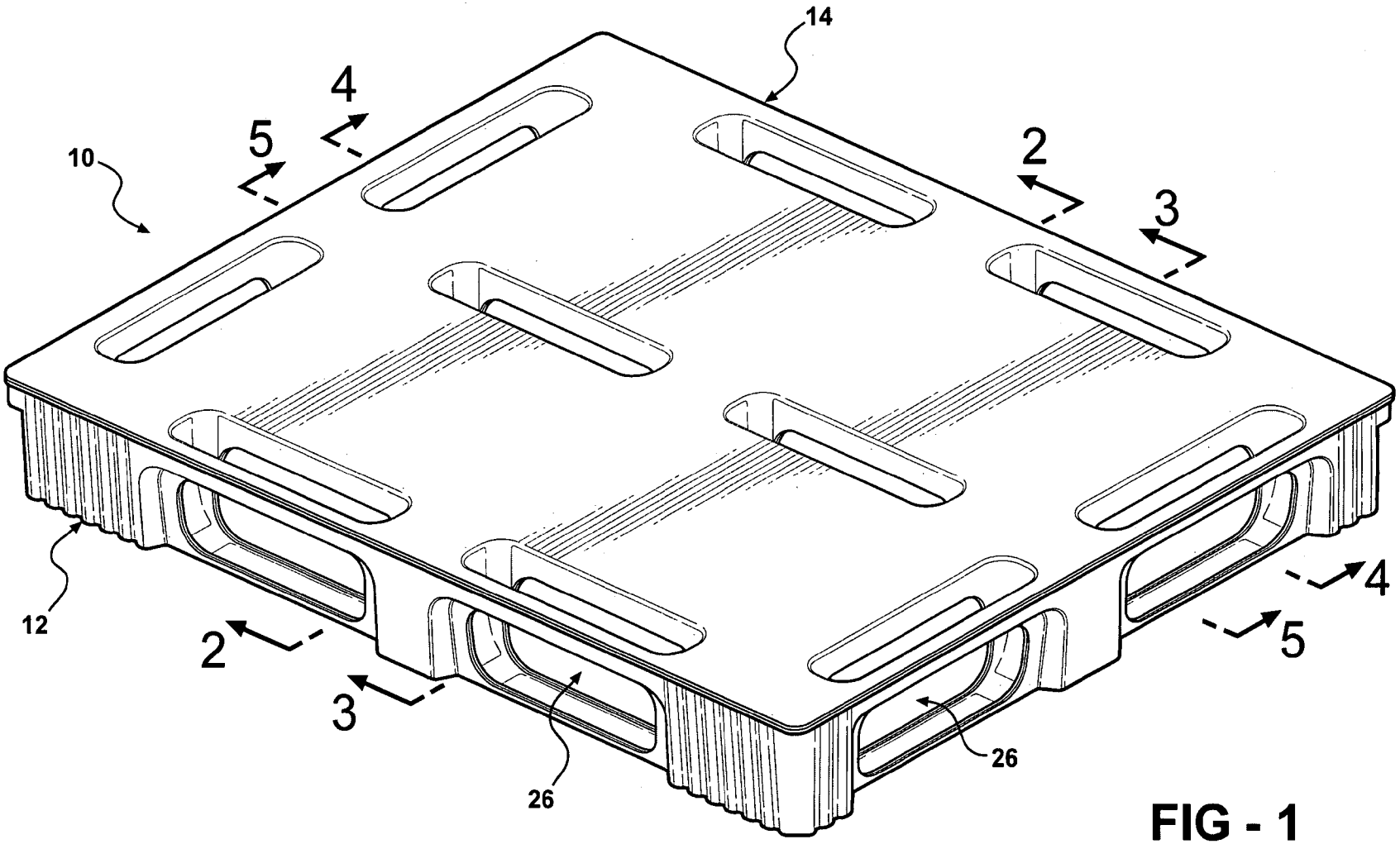
FIG. 1 is a perspective view of the invention pallet.
Figure 2:
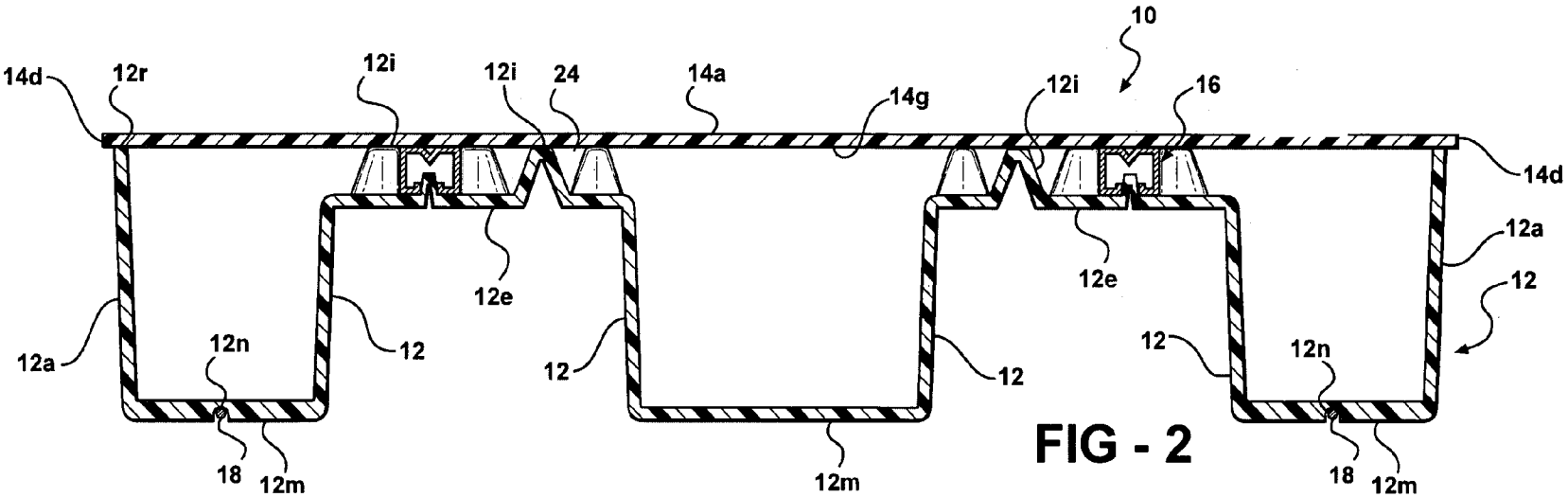
FIGS. 2, 3, 4 and 5 are cross-sectional views taken respectively on lines 2-2, 3-3, 4-4 and 5-5 of FIG. 1.
Figure 3:
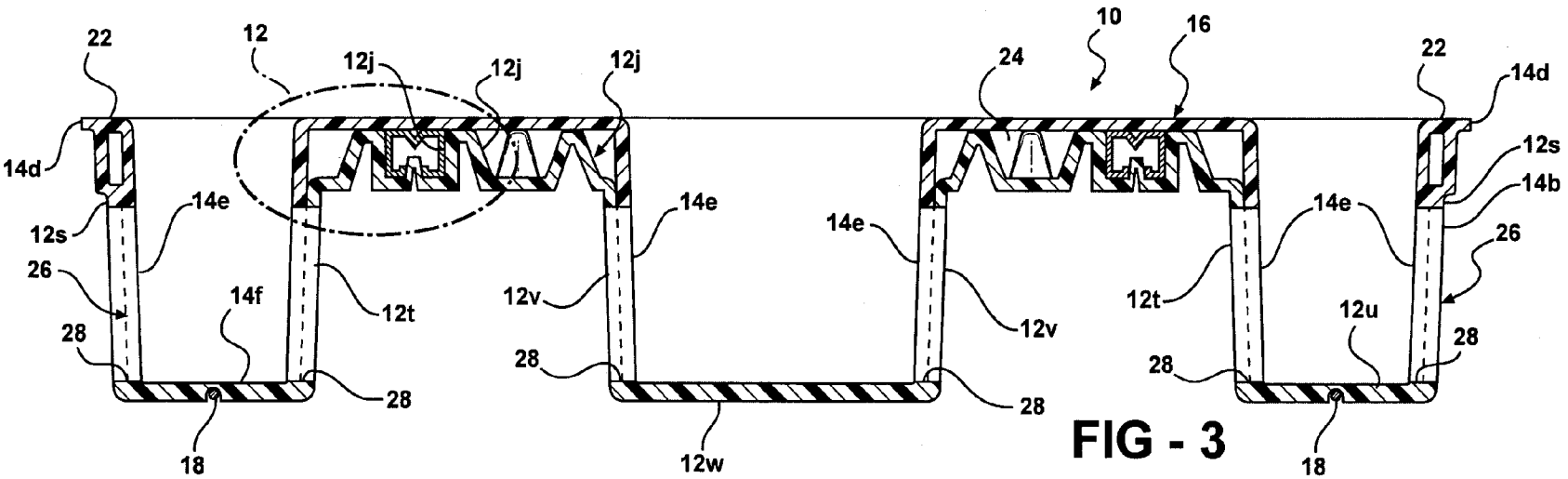
Figure 4:
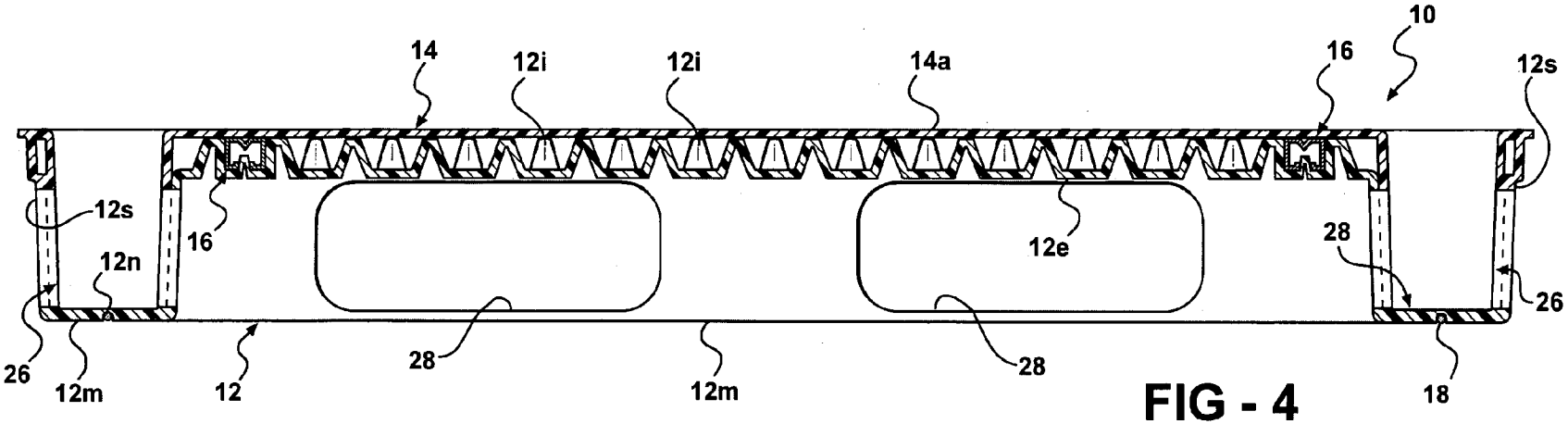
Figure 5:
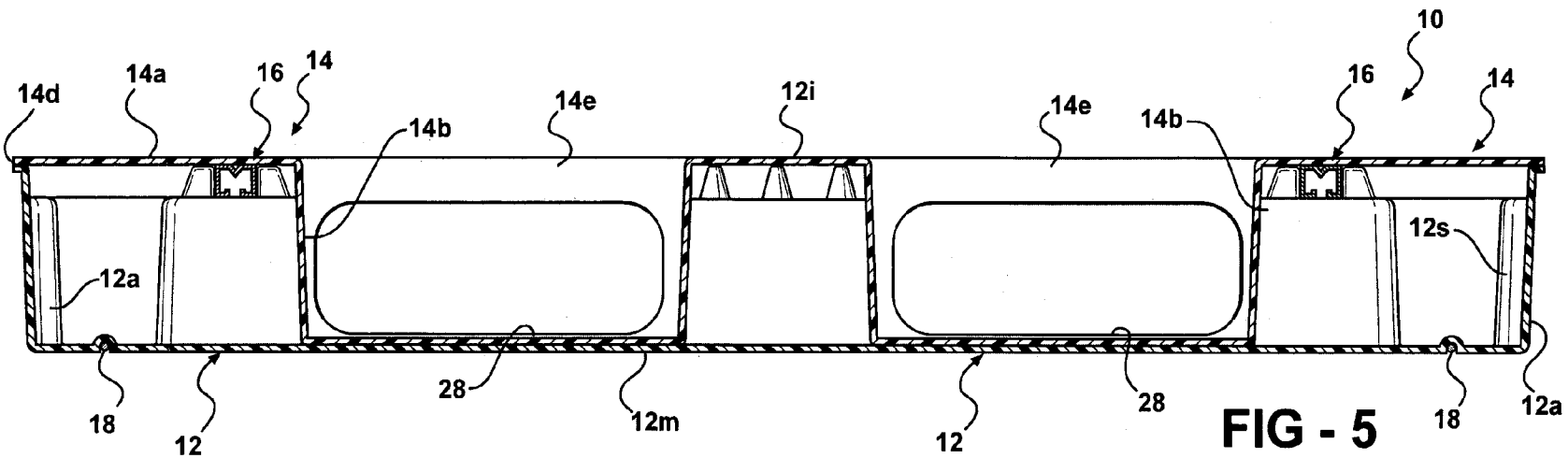
Figure 6:
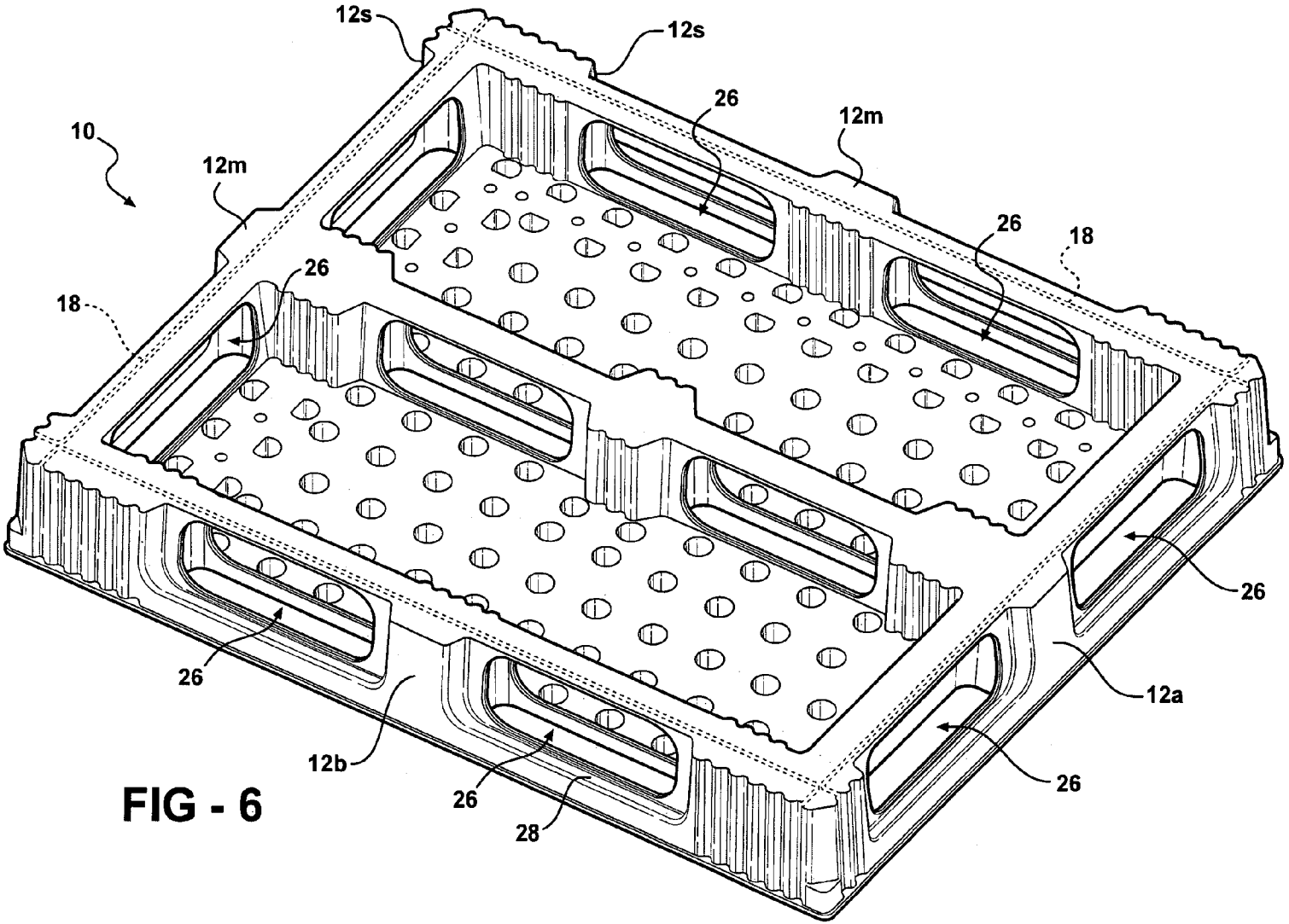
FIG. 6 is a bottom perspective view of the pallet.
Figure 7:
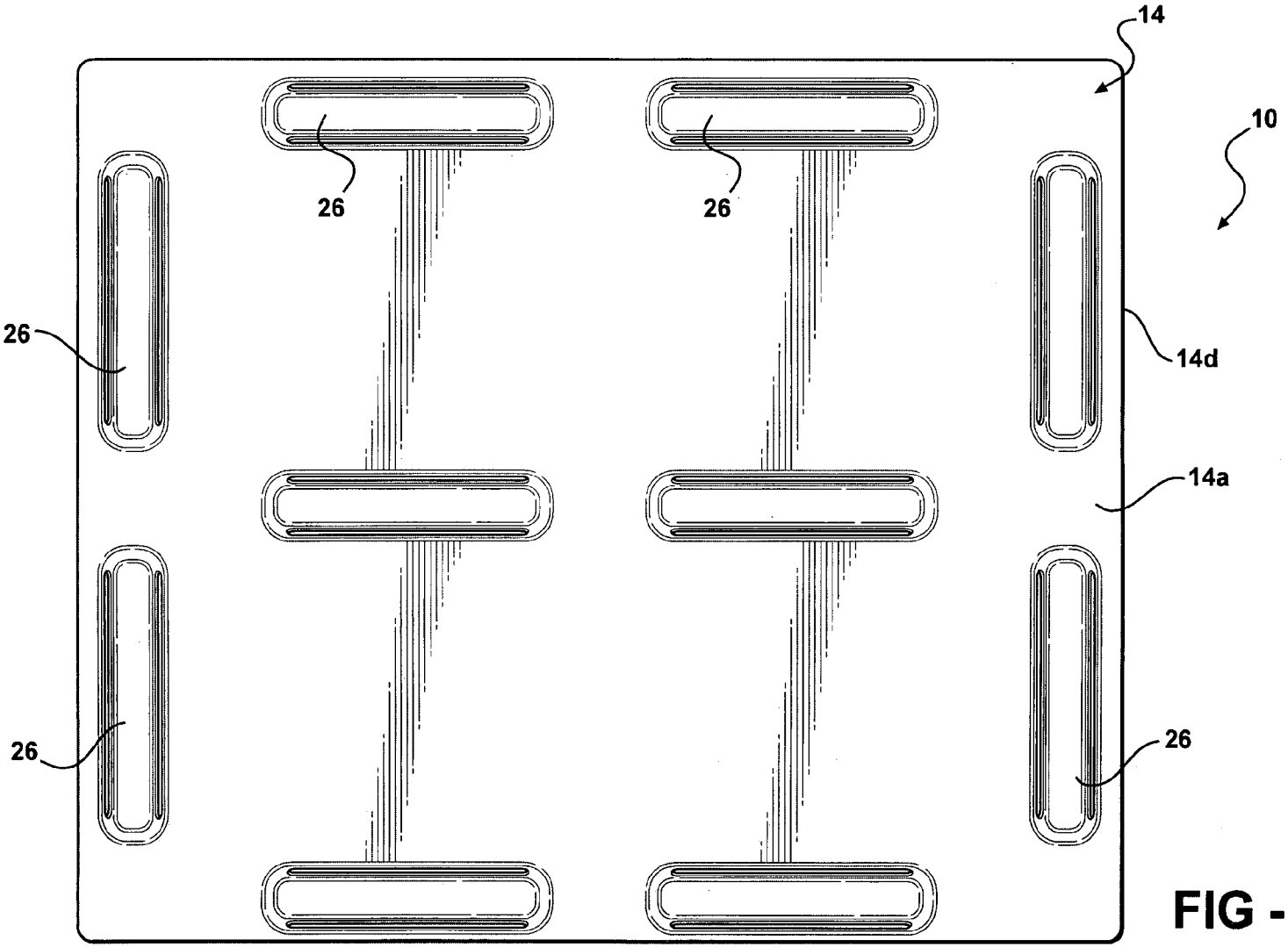
FIG. 7 is a top view of the pallet.
Figure 8:
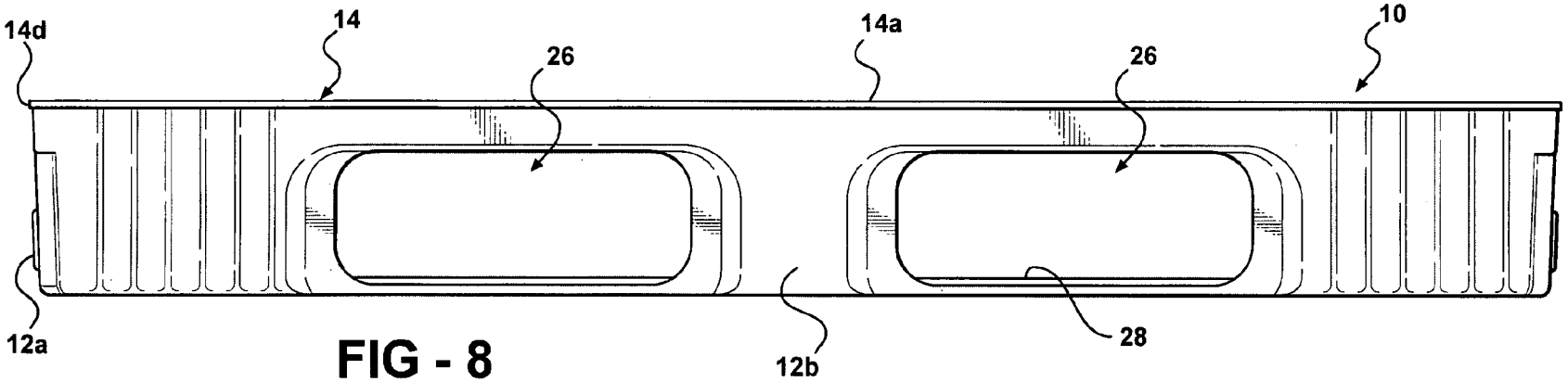
FIG. 8 is a side view of the pallet.
Figure 9:
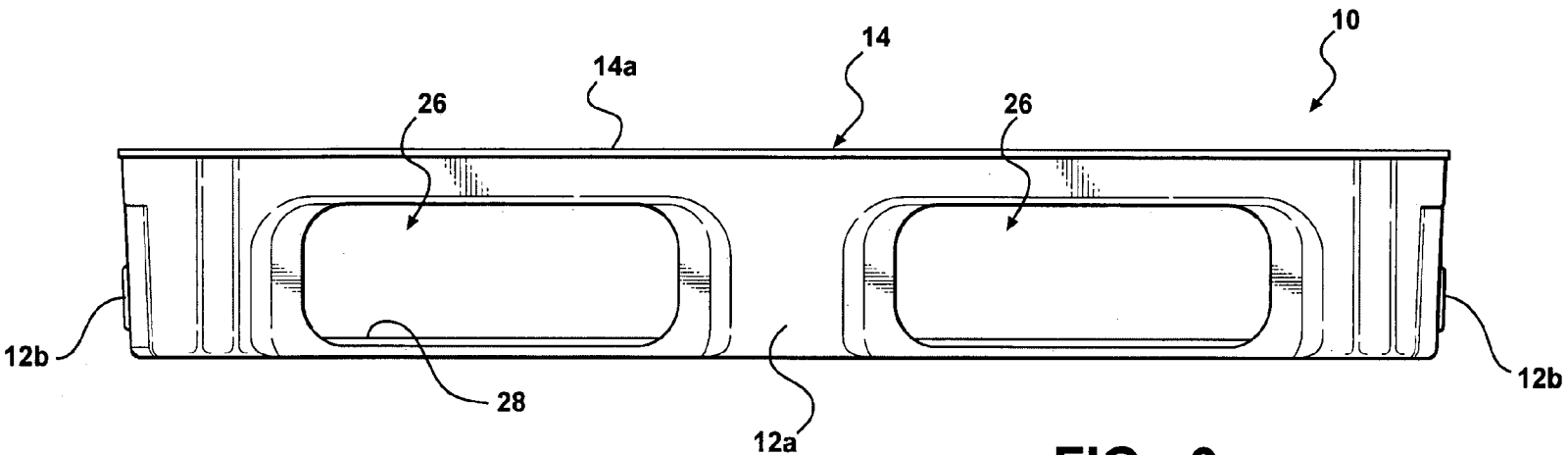
FIG. 9 is an end view of the pallet.
Figure 10:
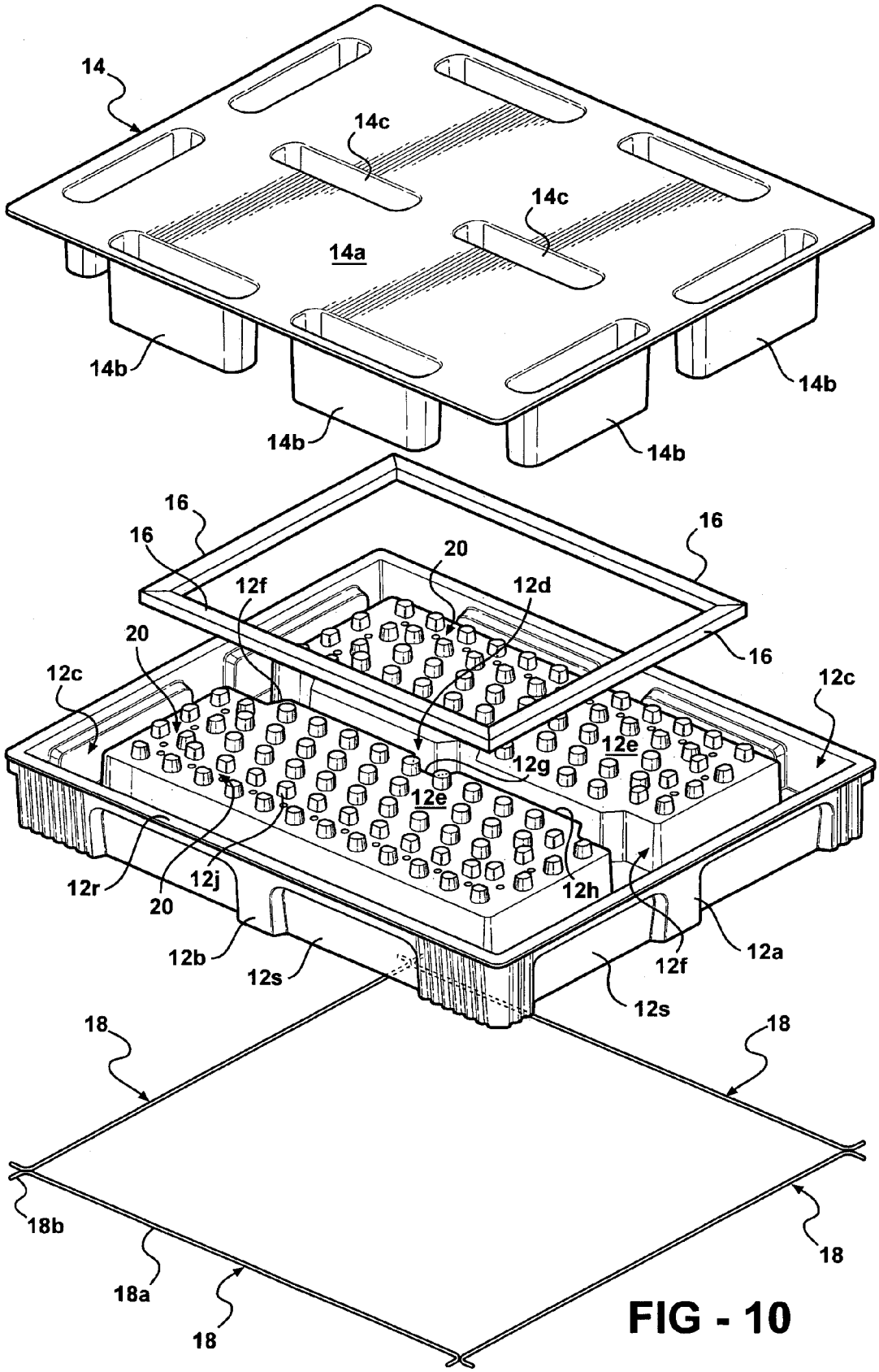
FIG. 10 is an exploded view of the pallet.

In overview, the invention pallet is formed of lower and upper plastic sheets 12 and 14, knitted or fused together, four reinforcing steel beam members 16 encapsulated between the upper and lower sheets, and four metal rods 18 encapsulated in the underface of the pallet. Sheets 12 and 14 may be separately molded in a vacuum thermoforming process, may be formed of an organic polymeric material such as polyethylene, and may be knitted or fused together to form the pallet in a compression molding process. The molds for vacuum forming the sheets are not shown but may be constructed in accordance with known vacuum thermoforming techniques.

Each of the upper and lower sheets is formed from a generally rectangular planar plastic sheet and the sheets are fused together utilizing the molds while the sheets are in a heated moldable state so that fusion may occur between the upper and lower sheets at any point where an interface is defined between the upper and lower sheets.

Lower sheet 12 starts out as a generally rectangular sheet of polyethylene plastic material and is vacuum thermoformed in known manner utilizing a suitable lower mold. Lower sheet 12 includes upstanding end walls 12*a*, upstanding sidewalls 12*b*, a continuously upwardly opening peripheral groove 12*c* extending around the perimeter of the sheet, a central upwardly opening groove 12*d* for connecting the portion of the peripheral groove 12*c* proximate one end wall 12*a* with the portion of the peripheral groove 12*c* proximate the opposite end wall 12*a*, and top wall portions 12*e* extending between side edge portions of the groove 12*c* and the central groove 12*d*. Central groove 12*d* includes enlarged end portions 12*f*, an enlarged central portion 12*g*, and narrow portions 12*h* extending between portions 12*f* and 12*g*.

Lower sheet 12 further includes a plurality of upwardly extending hollow spacer knobs 12*i* provided on the upper face of each top wall portion 12*e*. The knobs are provided in laterally spaced rows along the entire length and width of the top walls 12*e*. Knobs 12*i* have a circular truncated cone configuration except that the confronting faces 12*j* of the outboard knob rows extending lengthwise and widthwise of the sheet are flatted to define longitudinal channels 20 for seating and locating the respective beam members 16. It will be seen that a channel 20 is provided along each outboard lengthwise edge of the sheet to accommodate a longitudinally extending beam 16 and further channels 20 are provided along each outboard end edge to accommodate a transversely extending beam 16. Note that the channels 20 along the outboard end edges to accommodate transverse beam 16 are each interrupted by an enlarged end portion 12*f* of the groove 12*d*. A row of downwardly opening upwardly extending locator knobs 12*k* are also provided in each top wall 12*e* between the rows of flatted outboard spacer knobs. Locator knobs 12*k* are staggered with respect to, and smaller than, spacer knobs 12*i*.

The underface 12*m* of continuous groove 12*c* will be seen to define a continuous rectangular perimeter footprint surface for the pallet and a downwardly opening channel 12*n* is formed along each side of the rectangular footprint surface. Each channel 12*n* includes a straight central main body portion 12*p* extending parallel to a respective side edge of the footprint surface and cranked or angled end portions 12*q* opening in the respective side edge of the footprint surface proximate a respective corner of the footprint surface.

Upper sheet 14 starts out as a generally rectangular sheet of polyethylene plastic material and is vacuum thermoformed in known manner utilizing a suitable upper mold. Upper sheet 14 includes a generally planar top wall 14*a*, forming the platform structure for the resulting pallet, a plurality of circumferentially spaced upwardly opening "U" shaped protrusions 14*b* extending downwardly from the top wall, and a plurality of central "U" shaped protrusions 14*c* extending downwardly from the top wall. Protrusions 14*b* and 14*c* are sized to fit nestingly and snugly within peripheral groove 12*c* and central groove 12*d* respectively with two spaced protrusions 14*b* positioned along each side edge of the peripheral groove, two protrusions 14*b* positioned in each end portion of the peripheral groove, and two protrusions 14*c* positioned in the narrow portions 12*h* of central groove 12*d*.

Figure 11:
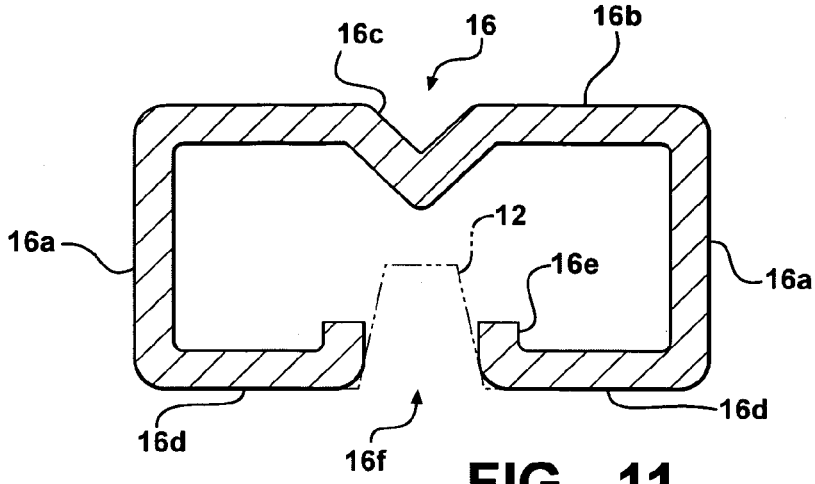
FIGS. 11, 12, 13, 14 and 15 are fragmentary views showing details of reinforcing beam members.
Figure 12:
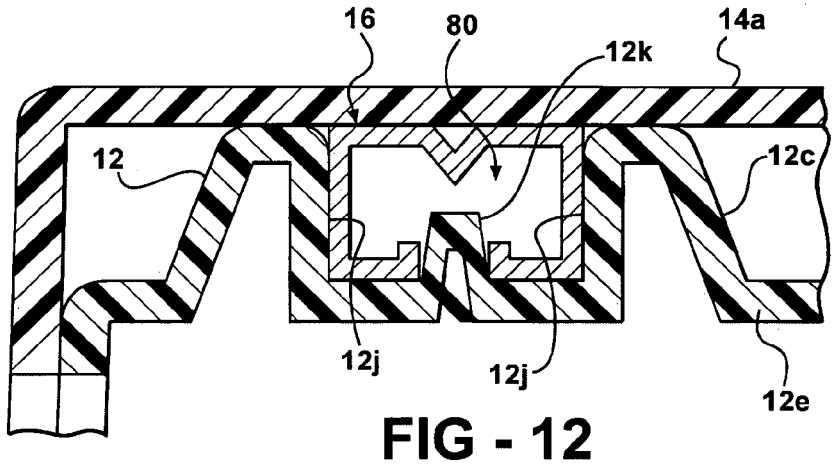
Figure 13:
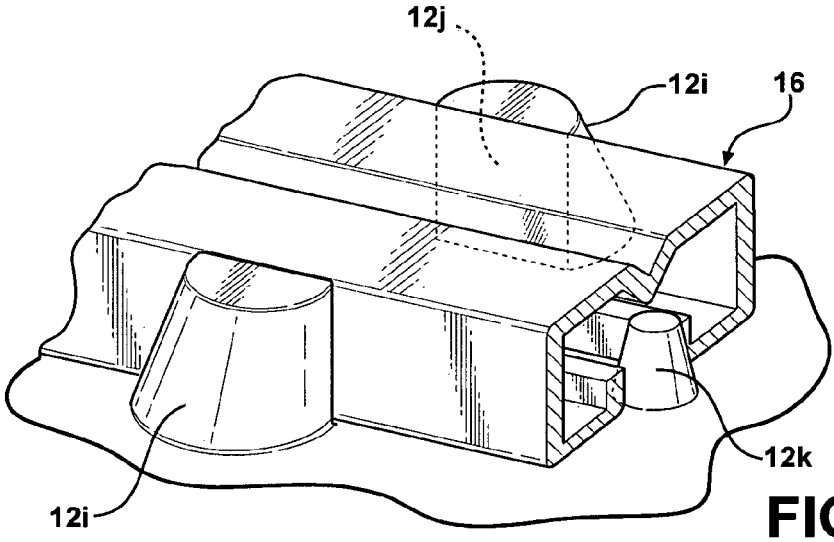
Figure 14:
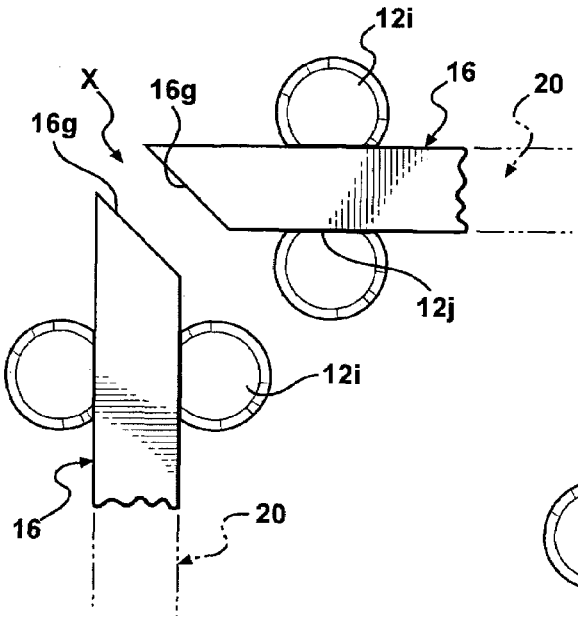
Figure 15:
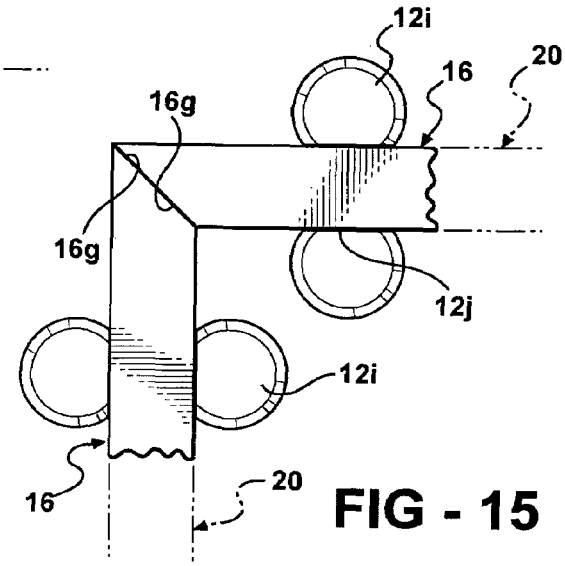
Figure 16:
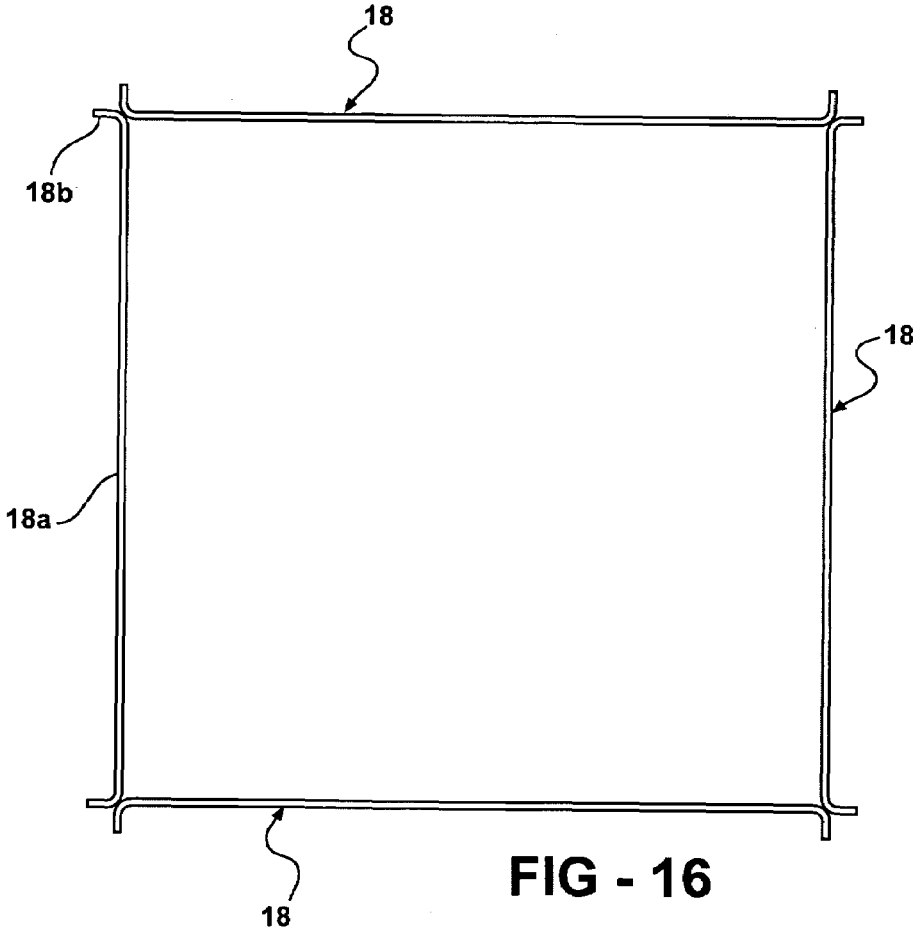
FIG. 16 is a view of reinforcing rod members.
Figure 17:
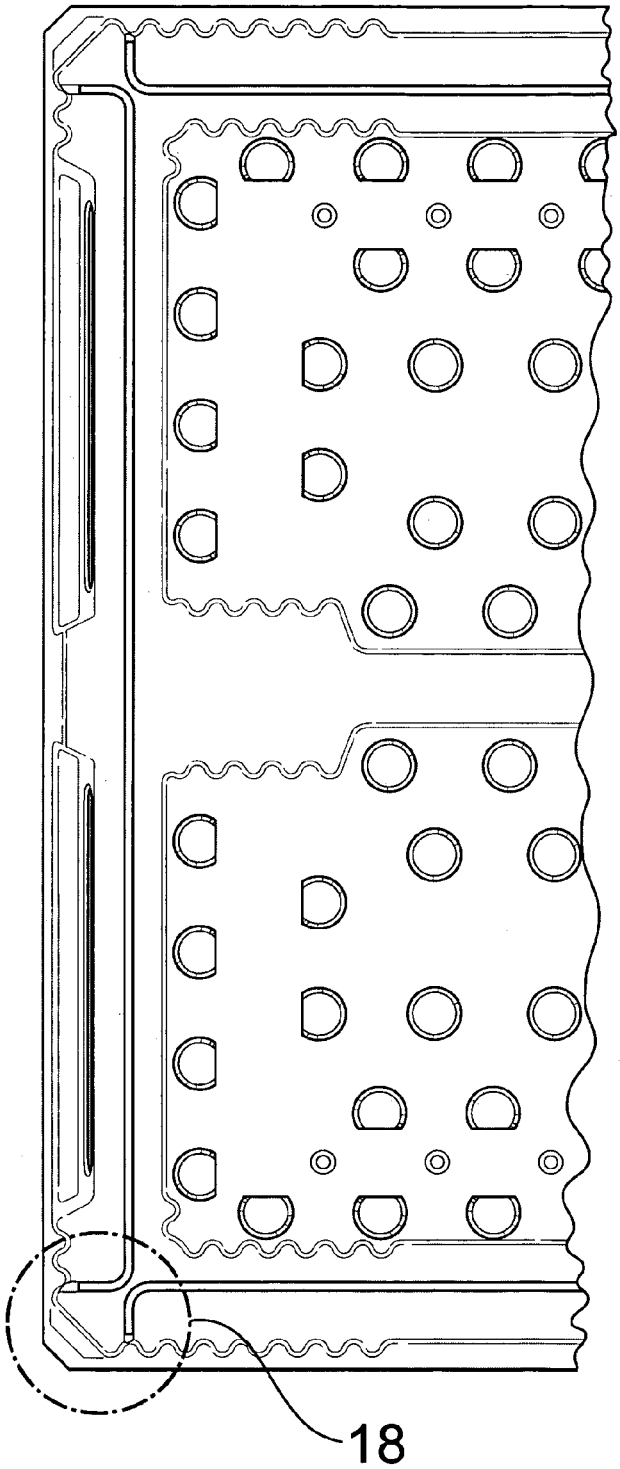
FIG. 17 is a fragmentary bottom view of the pallet.
Figure 18:
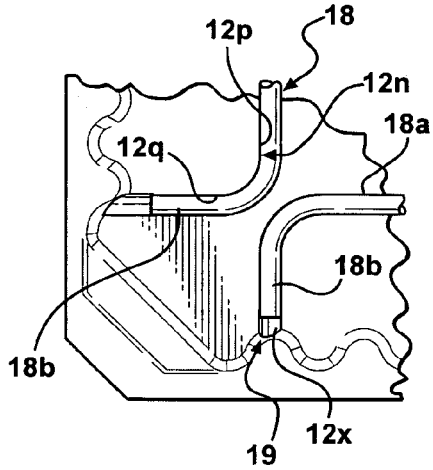
FIG. 18 is a detail view taken within the circle 18 of FIG. 17.
Figure 19:
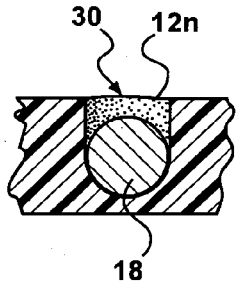
FIG. 19 is a detail view looking in the direction of the arrow 19 in FIG. 18.
Figure 20:
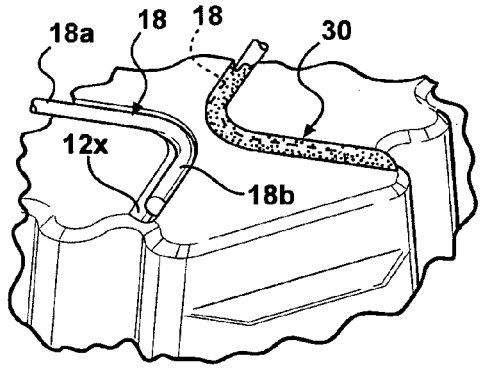
FIG. 20 is a fragmentary perspective view of the pallet structure seen in FIG. 18.

As best seen in FIGS. 11, 12 and 13, each beam 16, in cross section, include sidewalls 16*a*, a top wall 16*b* including a central "V" 16*c*, and spaced bottom wall sections 16*d* terminating in lips 16*e* defining a central slot 16*f*. Beam members 16 include two end transverse beam members having a length generally corresponding to the channel structure 20 defined at each end of the lower sheet and a pair of longitudinally beam members 16 each having a length generally corresponding to the length of the channel structures 20 provided along the side edges of the lower sheet. As best seen in FIGS. 14 and 15, each end 16*g* of each beam member has a 45° bevel configuration.

Each rod 18 is sized to fit in a respective channel 12*n* and includes a straight main body portion 18*a* a sized to fit in a respective channel main body portion 12*p* and cranked or angled end portions 18*b* sized to fit in respective channel end portions 12*q*.

Following the vacuum forming operations to form the upper and lower sheets, and with the upper and lower sheets still in a heated moldable state, beam members 16 are positioned in the respective channel structures 20. The parameters of the various parts are chosen such that with the lower sheet in a heated condition, beam members 16 when placed in end to end relation within the channel structures 20 are spaced apart at their beveled ends by a distance "X" as best seen in FIG. 14.

Following the positioning of the beam members within the channel structures 20 of the lower sheet with the beveled ends 16*g* of adjacent beam members in spaced disposition, the molds are brought together in known fashion to compression press the upper sheet to the lower sheet to form the twin sheet pallet 10 with the beam member encapsulated between the upper and lower sheets and specifically with each beam member totally surrounded by upper sheet top wall 14*a*, a lower sheet top wall 12*e* and knob flats 12*j*. As the upper and lower sheets, in a heated moldable state, are brought together the plastic material of the sheets fuses or knits together in known manner at all areas where the upper and lower sheets form an interface. Specifically, the periphery 14*d* of the top wall 14*a* of the upper sheet is fused to the peripheral upper edge 12*r* of the lower sheets; the side walls 14*e* of each side protrusion 14*b* are fused to the inboard face of an indentation 12*s* in a side wall 12*b* or an end wall 12*a* of the lower sheet and an inboard wall 12*t* of the lower sheet; the bottom walls 14*f* of the protrusions 14*b* are fused to bottom walls 12*u* of the lower sheet groove 12; the side walls 14*e* of the central protrusions 14*d* are fused to side walls 12*v* of the lower sheet; the bottom wall 14*f* of each central protrusion 14*d* is fused to a respective portion of the central bottom wall 12*w* of the lower sheet; and the upper end of each hollow spacer knob 12*i* fuses to the underface 14*g* of the top wall 14*a* of the upper sheet.

As noted, the protrusions 14*b* are sized such that the outboard wall 14*e* of each protrusion 14*b* actually seats against the inboard face of a respective indentation 12*s* so that a space 22 is formed between the upper and lower sheets above and along the extent of each indentation 12*s*. Further, the knobs 12*i* serve to define a space 24 between the upper and lower sheets in the pallet areas between the side grooves and the central groove. Spaces 22 and 24 will be seen to define a twin sheet or double wall configuration for the pallet to provide structural rigidity for the pallet. Whereas all the walls of the pallet where interfaced walls of the upper and lower sheets have been fused together are illustrated as having a thickness of twice the thickness of each interface wall, it will be understood that in most applications the final thickness of the interfaced and fused together walls will be less than twice the thickness of the separate walls.

According to the invention methodology, as the pallet cools following the fusing together of the upper and lower sheets, the plastic material of the pallet shrinks significantly so that the pallet itself undergoes shrinkage both end to end and side to side to bring the spaced apart beveled ends 16*g* of the beam members together to form a continuous rectangular frame configuration within the pallet. Note that this methodology, whereby the beam members are not initially joined together to form a rigid frame structure but rather are placed individually within the channel structures with their beveled end in spaced relation, avoids the problem of having the knobs defining the channel structures pull away from the beam members as the plastic material of the pallet shrinks during the cooling process while the beam members maintain their initial rigid fixed positions within the upper and lower sheets with the result that the beam members in the final, cooled pallet, are loosely positioned within the upper and lower sheets rather than being firmly encapsulated in the channel structures according to the invention methodology.

Following the fusing together of the upper and lower sheets to form the pallet and after allowing the material of the pallet to cool, a cutting or routing step is performed to form a pair of slots 26 in the sidewalls of the pallet and extending laterally across the pallet to allow the entry of the forks of a forklift truck. Specifically, an oblong cut out 28 is formed in each indentation 12*s* of a sidewall 12*b*, in the outboard sidewall 14*e* and the inboard sidewall 14*e* of the nested protrusion 14*b*, in an inboard wall 12*t*, in an inboard wall 12*b*, in central protrusion side walls 14*e*, in an inboard wall 12*v*, in an inboard wall 12*t*, and the inboard and outboard sidewalls 14*e* of the nested protrusions 14*b*, and in the indentation 12*s* of the other sidewall 12*b*. Similar cutouts 28 are formed in the end walls of the pallet to define further slots 26. The slots 26 in the various walls of the pallet coact to facilitate the handling of the pallet by a forklift truck approaching the pallet from either direction. In the completed pallet the planar top wall 14*a* of the upper sheet defines a generally planar platform surface for receipt of a pallet load and the bottom walls of the peripheral groove in the lower sheet and the central groove in the lower sheet coact to define a pallet footprint including a continuous rectangular perimeter footprint joined by a central footprint of the central groove.

Also following the cooling of the pallet, the rods 18 are positioned in the respective channels 12*n*, with the main body rod portions positioned in the main body channel portions and the cranked or angled rod end portions positioned in the channel cranked end portions, whereafter plastic material 30 is positioned over each rod, in a plastic fusion welding operation, to encapsulate the rods in the lower face of the pallet. The plastic fussion material 30 also fills channel end portions 12*x* outboard of the ends of the rod crank ends so as to further encapsulate the rods. In the finished pallet, the plastic fusion material is flush with the underface of the pallet so as to hide the rods but not interfere with the ready movement of the pallet over transfer surfaces and transfer devices.

The invention pallet will be seen to provide many important advantages. Specifically, the encapsulated rectangular frame construction provides excellent rackability of the pallet in both directions, that is, whether racked end to end or side to side. Further, the invention construction provides a continuous longitudinally extending footprint along the underface of the pallet so that the pallet can pass easily over barriers and irregular transfer surfaces and transfer devices such for example as conveyors. Further the invention construction provides firm entrapment for the forks of the forklift truck so that the pallet even if unevenly loaded will not tend to tip off of the forks of the pallet as the pallet is lifted and transported by the fork. Further, the reinforcing rods augment the reinforcing action of the reinforcing beams and further contribute to the rackability of the pallet in both directions. Specifically, because the rod ends are cranked and the spaces around the rod ends are filled in with plastic weld, the bottom of the finished plastic pallet cannot stretch under edge racking tension beyond what the stretch rods will allow. In effect, the upper steel beams and the lower steel rods are held efficiently in shear by the plastic structure creating a combined plastic/steel truss much stiffer than the individual components would be if they were not locked together. The invention pallet is also extremely simple in construction and therefore relatively inexpensive to produce and yet is extremely sturdy so as to provide an extremely long useful life. The invention construction also lends itself to simple and effective cleaning operations between pallet usages.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

The invention claimed is:

1. A twin sheet plastic pallet including an upper plastic sheet and lower plastic sheet selectively fused together to form a generally rectangular pallet having an upper platform structure, characterized in that;

the pallet further includes a metallic support structure positioned beneath the platform structure between the upper and lower sheets and including a plurality of beam members arranged end to end in a rectangular frame configuration with each beam member generally parallel to a respective outer edge of the pallet;

each beam member is spaced inboard with respect to the respective outer edge of the pallet;

the pallet defines a peripheral groove structure opening upwardly in the platform structure between each beam member and the respective outer edge of the pallet;

the groove structure is formed by portions of the upper sheet fused to portions of the lower sheet;

the portions of the lower sheet forming the groove structure comprise a continuous upwardly opening peripheral groove extending around the perimeter of the lower sheet with bottom walls of the continuous groove forming a continuous rectangular perimeter footprint of the pallet;

the pallet further includes a metal rod structure positioned proximate the footprint surface along each side edge of the footprint surface; and each rod includes a substantially straight main body portion and angled end portions and the rods are arranged in end to end relation with the angled end portion of one rod positioned proximate but unconnected to the angled end portion of an adjacent rod.

2. A pallet according to claim 1 wherein each angled end portion extends outwardly toward the respective side edge of the footprint surface.

3. A twin-sheet plastic pallet including an upper plastic sheet and a lower plastic sheet selectively fused together to form a generally rectangular pallet having an upper platform structure, characterized in that:

the pallet further includes a metallic support structure positioned beneath the platform structure between the upper and lower sheets and including a plurality of beam members arranged in a rectangular frame configuration with each beam member generally parallel to a respective outer edge of the pallet;

each beam member is spaced inboard with respect to the respective outer edge of the pallet;

the pallet defines a peripheral groove structure opening upwardly in the platform structure between each beam member and the respective outer edge of the pallet;

the groove structure is formed by portions of the upper sheet fused to portions of the lower sheet;

the portions of the lower sheet forming the groove structure comprise a continuous upwardly opening peripheral groove extending around the perimeter of the lower sheet with bottom walls of the continuous groove forming a continuous rectangular perimeter footprint surface of the pallet; and the upper sheet defines a top wall forming the platform structure and a plurality of circumferentially spaced upwardly opening protrusions extending downwardly from the top wall and nesting within the continuous groove in the lower sheet to form the groove structure.

4. A twin sheet plastic pallet including an upper plastic sheet and a lower plastic sheet selectively fused together to form a generally rectangular pallet having an upper platform structure, characterized in that:

the pallet further includes a metallic support structure positioned beneath the platform structure between the upper and lower sheets and including a plurality of beam members arranged in a rectangular frame configuration with each beam member generally parallel to a respective outer edge of the pallet;

each beam member is spaced inboard with respect to the respective outer edge of the pallet;

the pallet defines a peripheral groove structure opening upwardly in the platform structure between each beam member and the respective outer edge of the pallet;

the pallet further includes a plurality of spacer knobs protruding from one of the sheets and fused to the other sheet and serving to space portions of the upper sheet from portions of the lower sheet;

at least certain of the spacer knobs are arranged in rows; and the beam members are positioned between adjacent rows of spacer knobs.

5. A pallet according to claim 4 wherein the spacer knobs are provided in and extend upwardly from the lower sheet and are fused to an underface of the upper sheet.

6. A pallet according to claim 5 wherein the pallet further includes upstanding locator knobs positioned between adjacent rows of spacer knobs and engaging an underface of a respective beam member.

7. A twin sheet plastic pallet including an upper generally rectangular sheet and a lower generally rectangular sheet selectively fused together to form a generally rectangular pallet having an upper platform structure, characterized in that:

the lower sheet is formed with a continuous peripheral upwardly opening groove and an intermediate upwardly opening groove extending from the peripheral groove proximate one side edge of the lower sheet to the peripheral groove proximate an opposite side edge of the lower sheet;

the upper sheet defines a top wall forming the platform structure and a plurality of circumferentially spaced upwardly opening protrusions extending downwardly from the top wall and fusedly nested in the continuous peripheral groove in the lower sheet to form a continuous double wall thickness peripheral groove structure, and a plurality of intermediate upwardly opening protrusions fusedly nested in the intermediate groove in the lower sheet to form a double wall thickness intermediate groove structure;

the pallet further includes aligned slots in the side walls of the peripheral groove structure and in side walls of the central groove structure to allow passage of the forks of a forklift truck; and the pallet further includes a plurality of spacer structures protruding from one of the sheets and fused to the other sheet and serving to space portions of the upper sheet between the groove structures from portions of the lower sheet between the groove structures.

8. A pallet according to claim 7 wherein:

the spacer structures comprise spacer knobs;

the spacer knobs immediately inboard of the peripheral groove structure are arranged in parallel adjacent rows; and metallic beam members are positioned between the adjacent parallel rows.

9. A method of forming a generally rectangular reinforced twin sheet plastic pallet comprising first and second plastic sheets selectively fused together with metallic beam members encapsulated therebetween, the method comprising:

thermoforming the first sheet to include four elongated channel structures arranged in end to end relation;

with the first sheet in a heated state, placing a beam member in each channel structure in end to end relation and with the adjacent ends of the beam members spaced apart;

thermoforming the second sheet and fusing it to the first sheet to encapsulate the beam members in the groove structures;

allowing the fused together sheets to cool to allow the pallet to shrink both end to end and side to side to bring the spaced apart ends of the beams together to form a continuous rectangular frame configuration;

the beam members having beveled ends which are brought together in response to pallet shrinkage to form a beveled joint between each set of adjacent beam members;

the channel structures being defined by parallel rows of spacer knobs protruding from the first sheet and fused to the second sheet and serving to space portions of the first sheet from portions of the second sheet and to define the depth of the channel structures.

10. A method according to claim 9 wherein:

the first sheet is a lower pallet sheet and the second sheet is an upper pallet sheet; and the knobs project upwardly from the lower sheet and are fused to an underface of the upper sheet.

11. A method of forming a rectangular reinforced twin sheet plastic pallet comprising first and second plastic sheets selectively fused together with metallic beam members encapsulated therebetween, the method comprising:

thermoforming the first sheet to include four elongated channel structures arranged in end to end relation;

with the first sheet in a heated state, placing a beam member in each channel structure in end to end relation and with the adjacent ends of the beam members spaced apart;

thermoforming the second sheet and fusing it to the first sheet to encapsulate the beam members in the groove structures;

allowing the fused together sheets to cool to allow the pallet the shrink both end to end and side to side to bring the spaced apart ends of the beams together to form a continuous rectangular frame configuration;

the first sheet being a lower plastic sheet and the second sheet being a upper plastic sheet;

the method including the further step of configuring an under face of the lower sheet to define a continuous rectangular perimeter footprint surface for the pallet and positioning a metal rod structure proximate the footprint surface along each side edge of the rectangular footprint surface;

the metal rod structure comprising a metal rod positioned along each side edge in a downwardly opening channel provided in the footprint surface;

following positioning of each rod in the respective channel, plastic material being fused into the opening of the channel to encapsulate the rod within the lower plastic sheets;

each rod including a substantially straight main body portion and angled end portions and the rods being arranged in end to end relation proximate the footprint surface with the angled end portion of one rod positioned proximate but unconnected to the angled end portion of an adjacent rod.

12. A method according to claim 11 wherein each angled end portion extends outward toward the respective side edge of the footprint surface.

13. A twin sheet plastic pallet including an upper plastic sheet and a lower plastic sheet selectively fused together to form a generally rectangular pallet having an upper platform structure, characterized in that:

an underface of the lower sheet defines a continuous rectangular perimeter footprint surface of the pallet;

a metal rod is positioned proximate the footprint surface along each side edge of the rectangular footprint surface;

each rod includes a substantially straight main body portion and angled end portions; and the rods are arranged in end to end relation with the angled end portion of one rod positioned proximate but unconnected to the angled end portion of an adjacent rod.

14. A pallet according to claim 13 wherein each angled end portion extends outwardly toward the respective side edge of the footprint surface.

15. A method of forming a twin sheet plastic pallet including an upper plastic sheet and a lower plastic sheet selectively fused together to form the pallet, the method comprising:

configuring the lower sheet so that an underface of the lower sheet defines a continuous rectangular surface for the pallet; and positioning a metal rod structure proximate the footprint surface along each side edge of the rectangular footprint surface;

the metal rod structure comprising a metal rod positioned along each side edge of a downwardly opening channel opening in the footprint surface;

each rod including a substantially straight main body portion and angled end portions; and the rods being arranged in end to end relation proximate the footprint surface with the angled end portion of one rod positioned proximate but unconnected to the angled end portion of an adjacent rod.

16. A method according to claim 15 wherein each angled end portion extends outwardly toward the respective side edge of the footprint surface.

* * * * *